US006077127A

United States Patent [19]

Wu

[11] Patent Number: 6,077,127

[45] Date of Patent: Jun. 20, 2000

[54] ELECTRICAL CONNECTION DEVICE

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/293,591

[22] Filed: Apr. 16, 1999

[30] Foreign Application Priority Data

Oct. 30, 1998 [TW] Taiwan ..... 87217995

[51] Int. Cl.[7] ..... H01R 9/22

[52] U.S. Cl. ..... 439/717; 439/701

[58] Field of Search ..... 439/701, 709, 439/712, 715, 717

[56] References Cited

U.S. PATENT DOCUMENTS 3,253,252 5/1966 Piperato et al. ..... 439/717
4,070,086 1/1978 Trafford ..... 439/717
4,469,393 9/1984 Chewning, Jr. et al. ..... 439/717
5,575,690 11/1996 Eaton ..... 439/717
5,879,199 3/1999 Belopolsky ..... 439/701

*Primary Examiner*—Hien Vu
*Attorney, Agent, or Firm*—Wei Te Chung

[57] ABSTRACT

An electrical connection device includes a plurality of receptacle units each receiving a connector therein. Each receptacle unit has two spaced side walls defining a space therebetween for accommodating the connector. The side walls form a dovetailed tenon and a dovetailed mortise thereon, respectively. The tenon and mortise of adjacent receptacle units of the electrical connection device are engageable with each other to fix the receptacle units together. The side walls each have a recess and a barb formed on inner surfaces thereof for engaging with a corresponding barb and recess of the connector thereby securing the connector in the receptacle unit.

10 Claims, 5 Drawing Sheets

ELECTRICAL CONNECTION DEVICE

BACKGROUND OF THE INVENTION

1. Field of the Invention

The present invention relates to an electrical connection device, and in particular to an electrical connection device comprising a plurality of connector units integrated together to form a unitary device.

2. The Prior Art

Electrical connectors are used to connect peripheral devices to a host device. As the technology of the electronics industry advances, the number of peripheral devices to be connected to a host device has increased significantly. The number of required connectors has accordingly increased. Conventionally, the connectors are individually mounted to a circuit board of the host device. Pertinent examples are disclosed in Taiwan patent publication Nos. 84104611, 85213720 and 86200240. However, individually mounting the connectors to the circuit board is laborious as well as time and cost inefficient. Furthermore, since each connector occupies space on the circuit board, the overall space required for mounting several connectors is significant and does not promote conservation of space.

Hence, it is desirable to have an electrical connection device that addresses the above problems of the prior art.

SUMMARY OF THE INVENTION

Therefore, an object of the present invention is to provide an electrical connection device that comprises a plurality of connector units integrated with each other to form a unitary device.

Another object of the present invention is to provide a unitary connector casing structure that allows a plurality of connectors to be combined together as a unitary device.

To achieve the above objects, an electrical connection device in accordance with the present invention comprises a plurality of receptacle units each receiving a connector therein. Each receptacle unit has two spaced side walls defining a space therebetween for accommodating the connector. The side walls form a dovetailed tenon and a dovetailed mortise thereon, respectively. The tenon and mortise of adjacent receptacle units of the electrical connection device are engageable with each other to fix the receptacle units together. The side walls each have a recess and a barb formed on inner surfaces thereof for engaging with a corresponding barb and recess of the connector thereby securing the connector in the receptacle unit.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
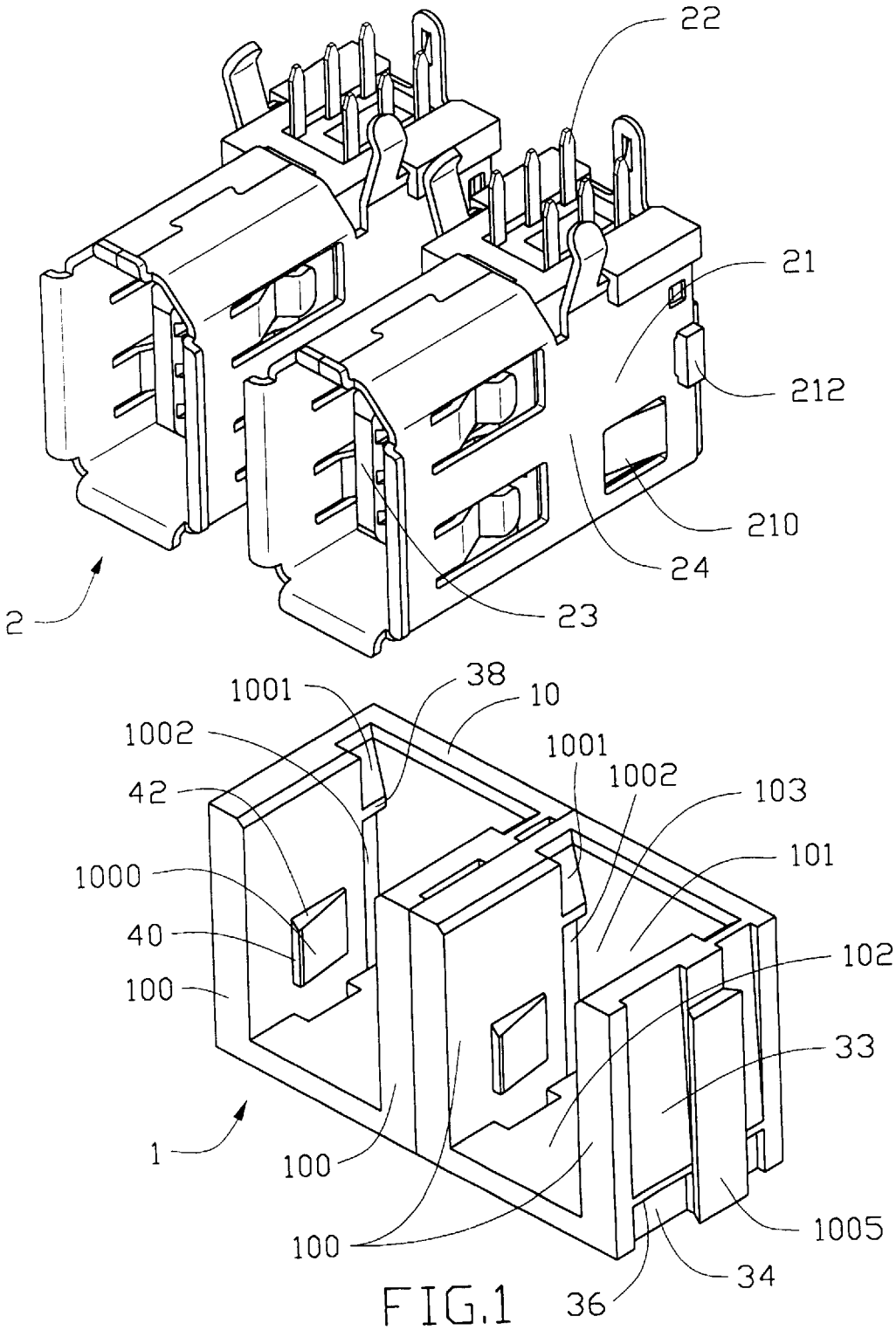
FIG. 1 is an exploded view of an electrical connection device in accordance with the present invention.
Figure 3:
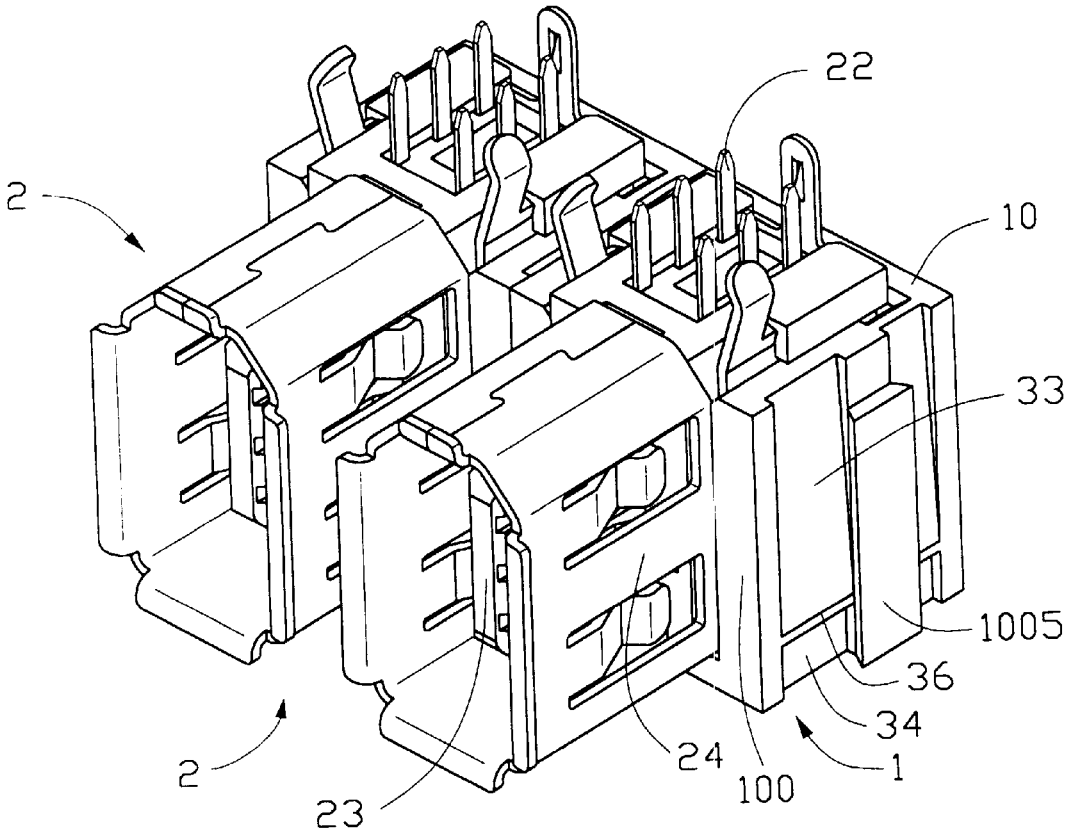
FIG. 3 is an assembled view of FIG. 1.

Referring to the drawings and in particular to FIGS. 1 and 3, wherein an electrical connection device constructed in accordance with the present invention is shown, the electrical connection device comprises a housing 1 made of nonconductive material. The housing 1 comprises a plurality of receptacle units 10 fixed together to form a unitary member. Each connector 2 includes a casing 23, a plurality of conductive pins 22 retained in the casing 23, and a shell 24 shrouding the casing 23. Each receptacle unit 10 receives and engages one connector 2, and the connector 2 has a portion forwardly extending beyond the receptacle unit 10 for engaging with a mating connector (not shown).

Each receptacle unit 10 comprises two opposite side walls 100 spaced from each other and defining a space 103 therebetween for receiving the connector 2. A bottom connection wall 102 is formed between the side walls 100 and supports the connector 2 in the space 103. Preferably, the receptacle unit 10 further comprises a rear wall 101 formed between the side walls 100.

Figure 2:
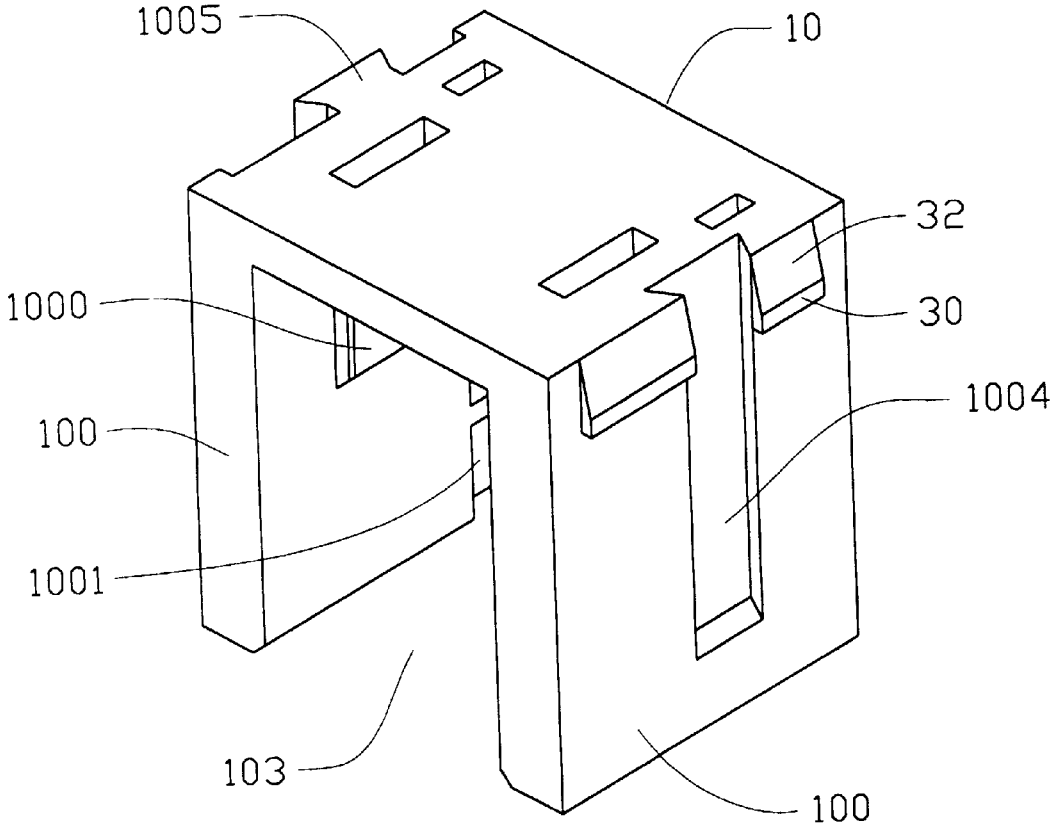
FIG. 2 is a perspective view of a connector receptacle unit of the electrical connection device of the present invention.

Also referring to FIG. 2, a dovetailed tenon 1005 and a dovetailed mortise 1004 are formed on outer surfaces of the side walls 100. The tenon 1005 and the mortise 1004 correspond to each other in both position and shape. By means of engagement between the tenon 1005 of a first receptacle unit 10 and the mortise 1004 of a second receptacle unit 10, adjacent receptacle units 10 are fixed together.

The outside surface of one of the side walls 100 has at least one barb 30 formed thereon. The outside surface of the other side wall 100 is provided with a recess 34 corresponding to the barb 30 and defining a shoulder 36. The first and second receptacle units 10 are secured together by guiding the barb 30 of the first receptacle unit 10 along a slot 33 in the outside surface of the side wall 100 of the second receptacle unit 10 until the barb 30 locks in the recess 34 of the second receptacle unit 10, a top of the barb 30 abutting against a top of the shoulder 36 of the second receptacle unit 10. Preferably, the barb 30 has an inclined face 32 for facilitating engagement with the shoulder 36, and the slot 33 in the outside surface of the side wall 100 is an inclined slot cooperating with the inclined face 32 for guiding the engagement of the barb 30 with the recess 34.

Inner surfaces of the side walls 100 face each other and a recess 1002 is formed on each inner surface. The recess 1002 is bound by an end wall 38 which forms a shoulder. An inclined face 1001 extends from a top edge of the side wall 100 to the end wall 38. A projection 212 is formed on each of two side faces 21 of the connector 2 and is receivable in the corresponding recess 1002 by sliding over the end wall 38 along the inclined face 1001 of the corresponding side wall 100 thereby securing the connector 2 in the receptacle unit 10. Preferably, the projection 212 has a T-shaped configuration.

The inner surface of each side wall 100 of the receptacle unit 10 forms a barb 1000 thereon. The barb 1000 is receivable in a notch 210 defined in the side face 21 of the shell 24. The barb 1000 has a front end face 40 for engaging with a corresponding shoulder (not labeled) formed in the notch 210 thereby further securing the connector 2 in the receptacle unit 10. The barb 1000 has an inclined top face 42 for guiding the engagement thereof with the notch 210. In this way, a plurality of connectors 2 may be secured together in the receptacle units 10 and form a unitary device.

Figure 4:
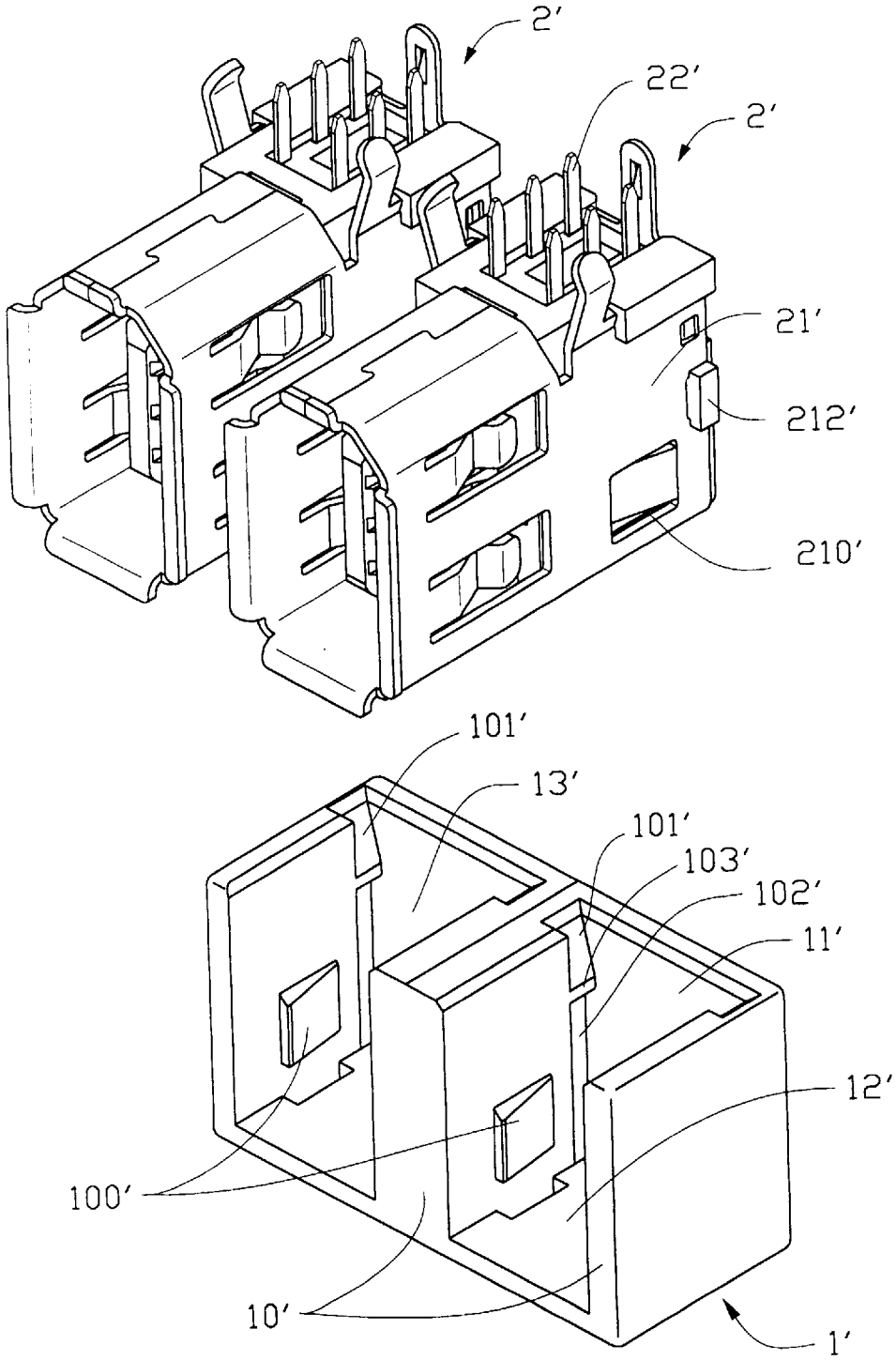
FIG. 4 is an exploded view of an electrical connection device in accordance with a second embodiment of the present invention.
Figure 5:
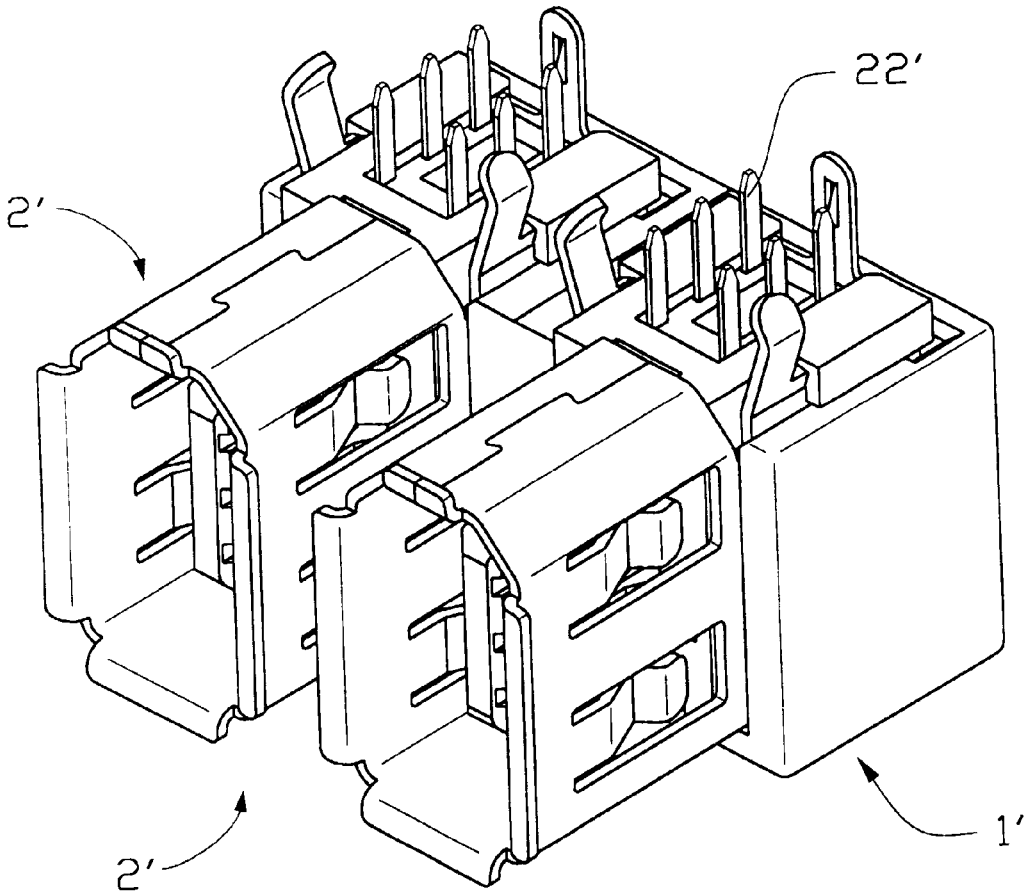
FIG. 5 is an assembled view of FIG. 4.

FIGS. 4 and 5 show another embodiment in accordance with the present invention. The electrical connection device of the present invention comprises a nonconductive casing 1' having a plurality of receptacle units (not labeled) integrally formed together. Each receptacle unit receives and retains a connector 2' therein. Each receptacle unit comprises two spaced side walls 10', each having an inner surface facing each other, and a bottom wall 12' and a rear wall 11' formed between the two side walls 10' to define an interior space 13' of the receptacle unit for accommodating the connector 2'.

A recess 102' is defined in the inner surface of each side wall 10'. An inclined face 101 ' extends from a top edge of the side wall 10' to an end wall 103' which bounds the recess 102'. The inner surface of the side wall 10' also forms a barb 100' thereon.

The connector 2' has conductive pins 22' disposed therein and two opposite side faces 21' each forming a T-shaped projection 212' for engaging the end wall 103' of the recess 102' by sliding over the end wall 103' along the inclined face 101'. The side face 21' of the connector 2' also defines a notch 210' for engaging the barb 100' of the corresponding side wall 10' of the receptacle unit.

Although the present invention has been described with reference to preferred embodiments thereof, it is apparent to those skilled in the art that there are a variety of modifications and changes that may be made without departing from the scope of the present invention which is intended to be defined by the appended claims.

What is claimed is:

1. An electrical connection device comprising:

a nonconductive housing having a plurality of receptacle units fixed together side by side, each receptacle unit comprising a first side wall and a second side wall, one of the side walls having an inner surface facing and spaced from a corresponding inner surface of the other side wall, a barb with an inclined face being formed on the inner surface of each side wall, a bottom connection wall being formed between the first side wall and the second side wall thereby defining a space therebetween; and a connector being received in the space of one of the receptacle units, the connector having a pair of side faces, each side face forming a notch therein for engaging with the barb of each side wall of the receptacle unit, thereby securing the connector in the corresponding receptacle unit of the housing; wherein a projection is formed of each of two side faces of the connector, and the inner surface of each side wall of the receptacle unit comprises a recess defining a shoulder for engaging with the projection.

2. The electrical connection device as claimed in claim 1, wherein the inner surface of each side wall of the receptacle unit comprises an inclined face extending from an edge of the side wall to the recess for guiding the projection of the connector unit into the recess.

3. The electrical connection device as claimed in claim 1, wherein the receptacle unit comprises an additional rear connection wall formed between the side walls for supporting the connector in the space thereof.

4. The electrical connection device as claimed in claim 1, wherein each of the side walls of the receptacle unit has an outside surface, the outside surface of the first side wall forming a dovetailed tenon and at least one recess thereon, the outside surface of the second side wall forming a dovetailed mortise and a barb thereon, the tenon of a first receptacle unit being engageable with the mortise of a second receptacle unit to fix the first and second receptacle units together with the outside surface of the first side wall of the first receptacle unit positioned against the outside surface of the second side wall of the second receptacle unit, the recess of the first receptacle unit defining a shoulder the barb of the second receptacle unit engaging with the shoulder.

5. The electrical connection device as claimed in claim 4, wherein the barb of the second receptacle unit forms an inclined face for guiding the engagement of the barb with the shoulder of the first receptacle unit.

6. The electrical connection device as claimed in claim 5, wherein the outside surface of the first side wall of the first receptacle unit forms an inclined slot cooperating with the inclined face of the barb of the second receptacle unit to guide the engagement of the barb with the shoulder of the first receptacle unit.

7. The electrical connection device as claimed in claim 1, wherein the receptacle units are integrally formed together as a unitary casing.

8. An electrical connection device comprising:

a nonconductive housing having a plurality of receptacle units fixed together side by side, each receptacle unit comprising a first side wall and a second side wall, one of the side walls having an inner surface facing and spaced from a corresponding inner surface of the other side wall, a connection wall being formed between the first side wall and the second side wall thereby defining a space therebetween;

a connector being received in the space of each receptacle unit, the connector having a casing, a plurality of conductive pins retained in the casing and a metal shell for covering the casing, the connector having a portion forwardly extending beyond the corresponding receptacle unit; and connector retaining means including complementary structures respectively on the receptacle unit and the connector for engaging with each other, thereby securing the connector in the corresponding receptacle unit; wherein each receptacle unit further includes a bottom wall and a rear wall surrounding the space while leaving openings around a front portion and a top portion of said space so as to allow said portion of the shell and tails of conductive pins of the connector to extend outwardly beyond the receptacle unit.

9. The electrical connection device as claimed in claim 8, wherein the connector retaining means comprises a projection formed on each of two side faces of the connector and the receptacle unit retaining means comprises a recess defining a shoulder in the inner surface of each side wall for engaging with the projection.

10. The electrical connection device as claimed in claim 9, wherein the connector retaining means further comprises a barb formed on the inner surface of each side wall of the receptacle unit and each side face of the connector comprises a notch for engaging with the barb.

* * * * *